United States Patent [19]

Cheng

[11] 4,227,228

[45] Oct. 7, 1980

[54] MINIATURE SOCKETED FUSE FOR A DECORATIVE STRING OF SERIES-CONNECTED MINIATURE INCANDESCENT LAMPS

[75] Inventor: Paul S. Y. Cheng, P.O. Box 5714, Kowloon, Hong Kong

[73] Assignees: Albert V. Sadacca, Chicago, Ill.; Paul S. Y. Cheng, Kowloon, Hong Kong

[21] Appl. No.: 972,035

[22] Filed: Dec. 21, 1978

[51] Int. Cl.[2] ..... A47G 33/16; H01H 85/54

[52] U.S. Cl. ..... 361/104; 315/185 S; 337/262

[58] Field of Search ..... 337/1, 187, 194, 198, 337/255, 262, 268; 362/123; 315/185 S, 122; 361/104

[56] References Cited

U.S. PATENT DOCUMENTS

| | | | |
|---|---|---|---|
| 1,545,781 | 7/1925 | Long | 337/262 |
| 2,831,087 | 4/1958 | Sundt | 337/198 |
| 3,968,398 | 7/1976 | Lehmann et al. | 362/806 |
| 4,030,059 | 6/1977 | Tong | 337/262 |

*Primary Examiner*—William H. Beha, Jr.

*Attorney, Agent, or Firm*—Kirschstein, Kirschstein, Ottinger & Cobrin

[57] ABSTRACT

A fuse protects a decorative string set of series-connected miniature incandescent lamps from current overload. The fuse comprises a fuse body insertable into a compartment of a fuse socket wherein electrical contacts are located. A fuse wire which is supported on the body includes a central wire portion mounted in a bore of the body, a pair of intermediate wire portions extending through passageways formed in the body, and a pair of exposed end wire portions bent rearwardly to engage the outer surface of the body. A keying stud and recess are respectively formed on the socket and body to reliably establish an electro-mechanical connection between the exposed end wire portions and the contacts upon insertion of the body into the socket. A fuse plug is inserted into the bore to thereby enclose the central wire portion. All of the fuse parts, exclusive of the wire, are made of fire-resistant and electrically-insulating materials so that the central wire portion is enclosed in an environment resistant to heat and fire. The fuse is easy to manufacture and to assemble, particularly in mass production.

15 Claims, 4 Drawing Figures

MINIATURE SOCKETED FUSE FOR A DECORATIVE STRING OF SERIES-CONNECTED MINIATURE INCANDESCENT LAMPS

BACKGROUND OF THE INVENTION

1. Field of the Invention

A miniature fuse receivable in a miniature socket that is series-connected in a decorative string of miniature sockets that contain miniature incandescent lamps.

2. Description of the Prior Art

Heretofore, strings of miniature decorative incandescent lamps have constituted a large number of miniature sockets, for example, thirty-four sockets, each of which had a miniature such lamp press-fitted therein. This arrangement enabled both the sockets and the lamps to be of very simple design and of small size and low cost. The sockets, and therefore the lamps, were connected in series, and the lamps often were so constructed that if one of them blew out, an alternate, i.e. shunt path, was supplied for the current so that the string, as a whole, would continue to function. However, the shunt path was so designed that when the associated lamp filament burned out, the current flowing through the shunt was greater than the current that previously flowed through the shunt when it was connected in parallel with the filament.

Therefore, after a lamp blew out, the flow of current through the string increased. If such increase were permitted to rise above a predetermined current flow, the string would heat up and could ignite some adjacent object. The entire string could be damaged by the heat build-up. The remaining lamps would glow brighter, thereby reducing their working lifetimes. The wires could melt if the current was high enough, and the resulting heat could cause a fire and damage objects in one's home. Therefore, it was customary to include two fuses, one at each end of the string, and each fuse was connected in series.

Usually, the fuses used heretofore were designed to be press-fitted into miniature sockets. These fuses, as a rule, took the form of miniature incandescent lamps that were unshunted and the filaments of which were designed to burn out when the series current flowing through the string rose to too high a value thereby causing the unshunted filaments to act as fuses.

These prior fuses were designed to carry a heavier load than the balance of the miniature lamps inasmuch as they had to be prepared to assimilate and radiate the heat consequent upon the blowing of a few of the miniature lamps and the consequent increase in the series current. Likewise, the miniature sockets for these lamps were made heavier than the miniature sockets for the miniature lamps of the remaining components of the string. Hence, two different kinds of sockets had to be used with increase in the cost for making the socket and with increase in the cost for assembling the sockets in the string due to the necessity of maintaining the heavier and lighter sockets separate from one another and incorporating them at different points of the string, the fuse sockets being at the ends of the string.

These lamps, i.e. lamps which act as fuses, are shown in U.S. Pat. No. 4,030,059, although fuse lamps for Christmas trees date back more than a decade before that patent. The use of unshunted fuse lamps in combination with shunted miniature lamps is the subject of U.S. Pat. No. 3,968,398, although this combination likewise was sold more than a decade before that patent.

Other patents more remotely related to the present invention include U.S. Pat. Nos. 2,831,087; 3,110,787; and 4,080,039.

SUMMARY OF THE INVENTION

1. Purposes of the Invention

It is an object of the present invention to provide a fuse of the character described for use in a decorative lighting string including miniature sockets, which fuse is so structured that, in conjunction with the socket which receives it, it is less costly than the previously used combination of fuse lamp and miniature socket.

It is another object of the invention to provide a fuse of the character described which is less costly than a fuse lamp.

It is another object of the invention to provide a fuse of the character described which is particularly compact, small, constitutes very few parts, and is very simple to make and install in a string.

Heretofore, non-incandescent fuses have constituted relatively complex devices formed of many parts and intricate structures. In contrast therewith, it is another object of the invention to provide a fuse which, although non-incandescent during normal use, is far simpler than non-incandescent fuses of the prior art.

It is another object of the invention to provide a fuse of the character described which is uniquely adapted to mass production methods for making of its parts and for the assembly of the fuse whereby the cost of the fuse may be kept to a very low level.

It is another object of the invention to provide a fuse of the character described which will reduce the cost of the fused miniature decorative lighting set.

Other objects of the invention in part will be obvious and in part will be pointed out hereinafter.

2. Brief Description of the Invention

The present invention, i.e. a fuse, is used in connection with a decorative lighting string of the type which consists of a large number of miniature sockets, each of which is engaged by a miniature incandescent bulb. The bulbs are of the shunted type. These are bulbs which have a shunt strap usually connecting the wire leads and forming a path in parallel with the filament that bridges the ends of the leads within the glass envelope. These miniature bulbs are of standard construction. They are made literally by the millions. The bulbs have a non-conductive base which usually is a plastic such as polypropylene. Wires extending from the filament supporting leads are brought to spaced points at the exterior of the base where they ae folded back against the base to serve as contacts for the lamp.

The miniature lamp sockets are made of the same kind of plastic and are shaped to provide a well of non-circular configuration which matches the non-circular configuration of the lamp base. A pair of spaced contacts is supported within the lamp socket in a position to engage the turned back wires of the lamp when the same is push-fitted into the lamp socket. The contacts are connected to wires which form a series path for current through the several lamps in the string.

In accordance with the present invention, the fuse basically includes a fuse socket, a fuse body, a fuse wire, and a fuse plug. An elongated interior compartment is formed in the socket and a pair of electrical contacts are mounted in the compartment. The contacts are electrically connected in series with the string set of lamps.

The body is inserted with friction into the compartment. A bore having a base wall is formed at the trailing end of the body. A pair of spaced-apart legs is formed at the leading end of the body. A pair of interior passageways extend from the bore to the free ends or tips of the legs.

A central wire portion is mounted in the bore adjacent the base wall. A pair of intermediate wire portions extends through the passageways, and a pair of exposed end wire portions are bent generally rearwardly at the tips, so that the bent end portions overlie the outer surface of the legs.

The plug is inserted with frictional engagement into the bore to a position overlying the central wire portion. Inasmuch as all of the fuse parts, exclusive of the wire, are made of fire-resistant and electrically-insulating material, the central wire portion is enclosed in an environment which is resistant to heat and fire. In the event that the wire melts due to current overload, the generated heat will not be transmitted directly to the string set and/or any object in the circumambient region of the string set and/or fuse.

A keying stud is formed of one piece with the socket within its compartment. A keying recess is formed by the spacing between the legs of the body. The recess mates with the stud and properly locates the body relative to the socket such that the exposed wire end portions engage the contacts within the socket and establish an electro-mechanical connection therewith.

A flange is of one-piece with the body and facilitates gripping by a user. The leading ends of the plug and of the body are tapered to facilitate their respective mountings. The trailing end of the plug extends beyond the body and serves as a convenient handle. An adhesive seal is applied between the juncture of the plug and the body. The adhesive seal closes the open end of the bore from environmental conditions, and also fixedly secures the plug in the bore.

In accordance with this invention, the manufacture and assembly of the fuse is extremely easy to perform. The fuse wire is of uniform diameter. No special tooling is necessary to form the fuse element of differently sized sections as is customary is some prior art fuse filament constructions. The fuse body and socket are easy to make by mass production injection molding techniques. To assemble the body, it is only necessary to push the plug into the rear of the body. The known prior art constructions comprise a plurality of parts which must be carefully oriented, manipulated and assembled. The present invention obviates the prior art necessity for requiring skilled assembly personnel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
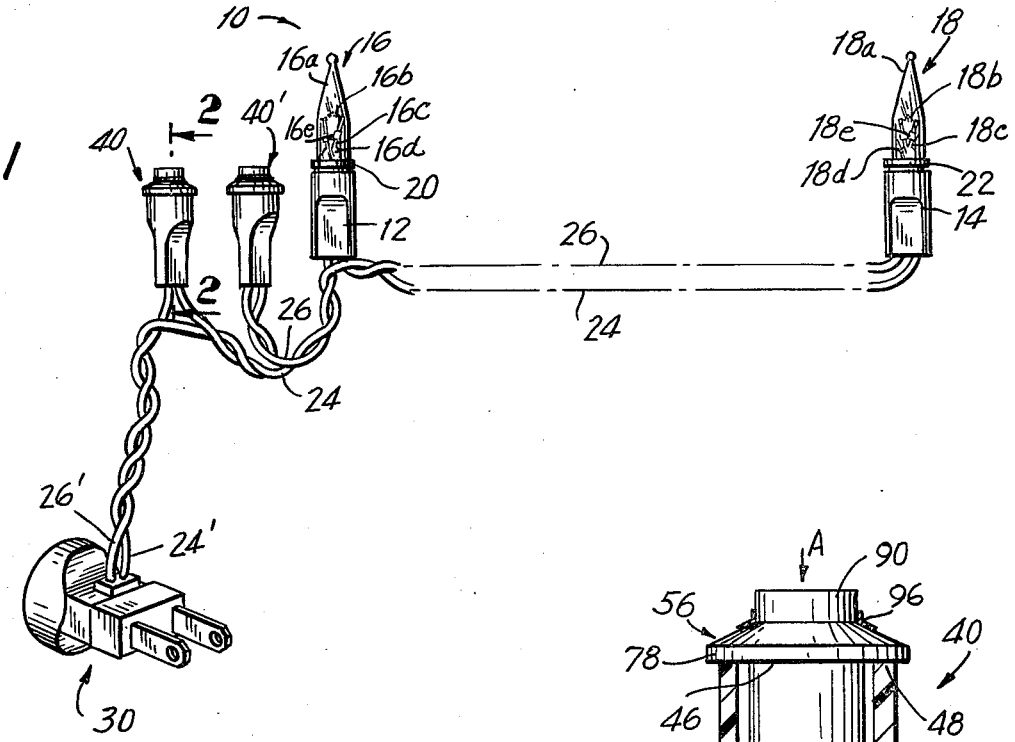
FIG. 1 is a perspective view of a pair of electrical fuses for protecting a partially schematically illustrated decorative string set of incandescent lamps in accordance with the invention.

Referring now to FIG. 1 of the drawings, a decorative string set 10 is schematically illustrated and comprises a plurality, for instance thirty-five, of molded miniature plastic lamp sockets, all identical to end sockets 12, 14, which are at opposite ends of the string. A corresponding plurality of shunted miniature lamps, e.g. 16, 18, are mounted in the lamp sockets. Lamps 16, 18 have molded miniature plastic lamp bases 20, 22 which are respectively insertable with frictional engagement into the sockets 12, 14. Lamps 16, 18 have a glass envelope **16*a*, 18*a*, a lamp filament 16*b*, 18*b*, and lead wires 16*c*, 18*c*, which are held together by beads 16*d*, 18*d*. A shunt or bypass metallic wire 16*e*, 18*e*** is wound around the lead wires just above the support bead.

Elongated flexible conductors 24, 26 interconnect the lamp lead wires in all of the lamp sockets and thereby form a string of series-connected sockets.

The string set also includes an electrical power plug 30 which is adapted to plug into a duplex outlet or extension cord for supplying voltage and current to the sockets and the lamps to operate the latter as a decorative light display, such as typically used for Christmas displays. Conductor 24' supplies electrical power to conductor 24 through the series-connected fuse 40; and conductor 26' supplies electrical power to conductor 26 through the series-connected fuse 40'.

It will be noted that fuses 40, 40' are respectively located at opposite ends of the series-connected string of lights. Put another way, fuse 40 is located intermediate one side (i.e. the positive side) of the power source and one end of the string of lamps, whereas 40' is located intermediate the other side (i.e. the negative side) of the power source and the opposite end of the string of lamps.

It will be further noted that all of the lamps are connected in series with each other. However, this does not mean that if one light filament burns out, that the entire string of lamps will be extinguished. In the event that lamp filament **16*b*, for example, burns out, then the bypass wire 16*e*** will conduct the current to the remaining lamps in the string. The only lamp that is extinguished is the one that is burned out. In other words, the set continues to operate minus the one bad lamp. The bypass wire is rated so that it will conduct the current which heretofore passed through the associated lamp filament.

The above described details of the string set are entirely conventional in this art and form no part of this invention. Instead, the present invention is concerned with the structural and functional aspects of the fuses 40, 40' which are operative to protect the string set in the event of a circuit malfunction, i.e. a current overload. Fuses 40, 40' are identical and, therefore, for the sake of brevity, only the details of fuse 40 will be described. Although it is customary in this art to provide two fuses at either end of the string set, it will be understood that a single fuse is all that is really necessary to protect the string set.

Figure 2:
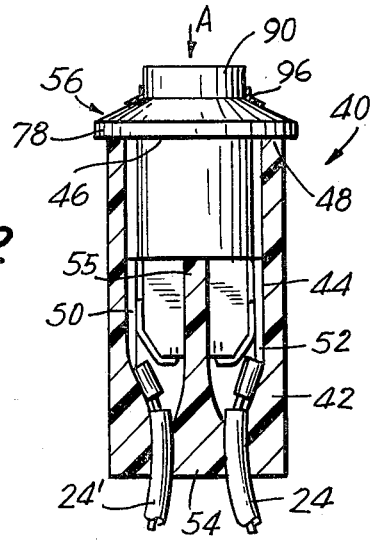
FIG. 2 is an enlarged cross-sectional view of a fully assembled fuse as taken along line 2—2 of FIG. 1.
Figure 3:
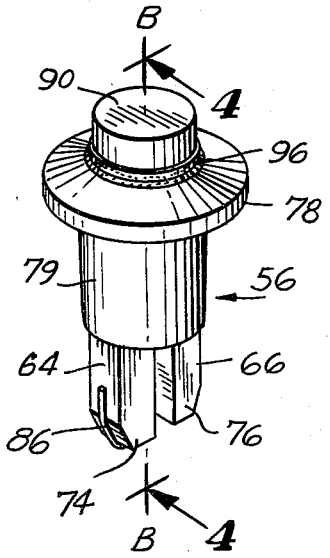
FIG. 3 is a perspective view of a detail of the fuse assembly of FIG. 2.
Figure 4:
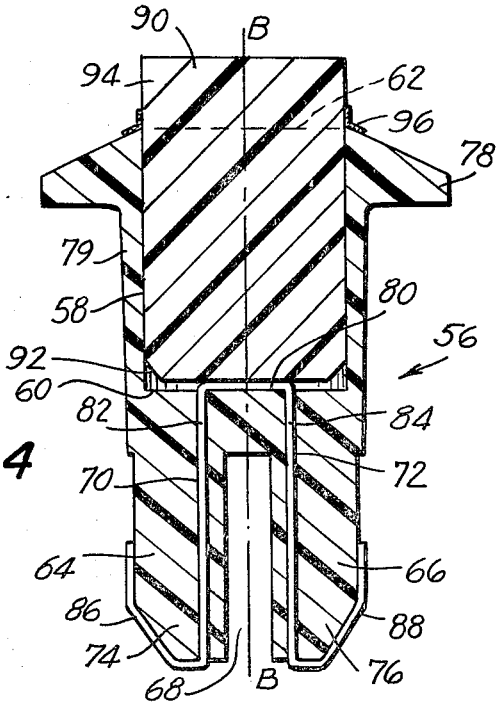
FIG. 4 is an enlarged cross-sectional view as taken along line 4—4 of FIG. 3.

Hence, turning now to FIGS. 2–4, the improved electrical fuse 40 comprises a fuse socket 42 constituted of a fire-resistant and electrically insulating material such as synthetic plastic material. Polypropylene is preferred because this material will not burn. Polypropylene may melt a little bit, but the mass of the fuse parts is enough to prevent the whole fuse from melting. The socket 42 has wall portions bounding an elongated interior compartment 44 which has an open end 46 that is surrounded by an annular rim 48. A pair of electrical contacts or blade portions 50, 52 are mounted in spaced-apart relationship within compartment 44. The lower ends of blades 50, 52 are electrically connected at the illustrated solder points or by mechanical crimping in series with conductors 24, 24' which extend through apertures formed in the socket 42 at its end region 54, that is, opposite to open end 46.

The connecting projection or stud 55 is of one piece with socket 42. The stud 55 is located within compartment 44 intermediate blades 50, 52 and extends upwardly lengthwise of the socket and terminates short of the open end 46 of the compartment.

The fuse also comprises an elongated fuse body 56 which is insertable with frictional engagement into compartment 44 through the open end 46 thereof in direction of arrow A. The body 56 is also constituted of fire-resistant and electrically insulating material such as polypropylene. As best shown in FIG. 4, the upper trailing axial end region of the body 56 is formed with a cylindrical bore 58 which has a base wall 60 and an open bore end 62. At the lower leading axial end region of the body 56, a pair of legs 64, 66 of one piece with the fuse body projects axially. The legs 64, 66 are spaced laterally apart of each other to define therebetween a keying recess 68 which is dimensioned to mate with the stud 55. The recess 68 receives stud 55 and thus properly locates the body 56 relative to the socket 42. Of course, it is also possible that the positions of the stud and the recess can be reversed; that is, the stud could have been positioned on the body, and the recess could have been positioned on the socket. The preferred contour of the stud is planar, which means that the complementary configuration of the recess 68 must also be planar. Of course, other configurations are likewise possible.

A pair of internal passageways 70, 72 extends respectively through the legs 64, 66. Each passageway communicates with the bore 58 and extends from the base wall 60 in direction along the symmetry axis B—B to the opposite leading lower end region of the fuse body, i.e. all the way through to the free ends or tips 74, 76 of the legs.

Both the tips 74, 76 and the fuse body side wall 79 are tapered so as to diverge in direction from the leading end toward the trailing end to thereby facilitate insertion of the body 56 into the socket 42. To further facilitate such insertion and/or removal, a circular flange 78 of one piece with the body is provided at its upper trailing end. The flange 78 extends radially outwardly for a predetermined distance in order to provide a convenient gripping handle for the body.

The fuse further comprises a bendable electrically conductive metallic fuse wire constituted of a Wollaston wire filament or the like, and of appropriate size for the current rating desired. The fuse wire is of uniform diameter and has a central wire portion 80 which is located in bore 58 in abutment with base wall 60. The wire includes a pair of intermediate wire portions 82, 84 at opposite ends of central wire portion 80. Each intermediate wire portion is located in and extends through a respective passageway 70, 72. The wire further includes a pair of bent exposed end wire portions 86, 88 at the extreme opposite ends of the wire. Each bent end wire portion is folded generally rearwardly in the direction from the leading end back towards the trailing end of the body. Specifically, each bent wire portion is first bent radially upwardly for a short distance on the axial end face of the respective tip. Thereupon, each end wire portion is bent such that it abuts against the inclined tapered outer surface of the respective tip. Finally, each bent wire portion is bent such that it lies generally parallel to the intermediate wire portions. The bent end wire portions overlie the outer surface of the fuse body at its leg tips. This exposed position of the end wire portions establishes an affirmative electro-mechanical connection between the ends of the fuse wire and the contact blades 50, 52 after the body has been inserted into the socket. The fuse also comprises a fuse plug 90 made of fire-resistant and electrically insulating material such as polypropylene. The plug 90 is inserted with frictional engagement into the bore 58 through the open end 62 thereof in direction of the arrow A. The plug is inserted into a position above central wire portion 80 and preferably engages the same. Consequently, the central wire portion is completely enclosed in an environment by fire-resistant and electrically insulating material. In the event that the central wire portion 80 melts due to a current overload, the resulting heat will be greatly attenuated before it reaches the exterior of the fuse. The plastic fuse parts will not burn when the fuse wire incandesces. It may melt a little bit inside, but that is all. The mass of the various fuse parts is enough to prevent the entire fuse from melting. This protects not only the string set, but also any objects in the circumambient region of the set from being affected by high heat.

The plug 90 is shaped as a cylinder to fit snugly into the bore 58. However, it will be understood that any shape can be selected for the plug 90 and the corresponding complementary contour would then be chosen for the bore. To facilitate insertion into the bore 58, the leading plug end 92 is tapered. The length of the plug is selected such that the trailing plug end 94 extends beyond the open bore end 62. This plug extension 94 serves as a convenient handle or gripping aid. A seal 96 is applied about the juncture between the plug extension 94 and the upper surface of the flange 78. The seal 96 is an adhesive layer which coats and surrounds the entire circular periphery of the extension 94 at the aforementioned juncture. Once set, the adhesive seal extends from the extension 94 to the flange 78 and serves a dual purpose. The first is to fixedly secure the plug in the bore in the event that improper manufacturing tolerances provide a loose fit between the plug and bore. The second is to seal the interior of the bore from the exterior of the fuse, thereby making certain that the central wire portion of the fuse is sealed in an environment which is protected from moisture and other environmental conditions.

The manufacture of the fuse is extremely simple. The socket has one basic injection-molded part, and the fuse body has two basic injection-molded parts. The assembly of the fuse is likewise easy to perform. The opposite ends of the fuse wire are inserted through the oversized passageways 70, 72 until the central wire portion 80 abuts against the base wall 60. Thereupon, the exposed ends of the wire are manually folded backwardly against the outer surface of the legs. The plug 90 is pushed into the bore of the body thereby enclosing the central wire portion in a protected environment. If desired, an adhesive seal is applied at the junction between the plug and the fuse body to thereby seal the open end 62 of the bore.

In use, the fuse body 56 is merely inserted into the compartment 44 of the socket. Electrical connection is established between the exposed wire end portions 86, 88 and the contacts 50, 52.

The two fuse sockets are made such that they will mate with only the fuse bodies. This eliminates the possibility of a consumer's attempting to fit a lamp into a fuse socket, rather than a lamp socket. Of course, the fuse sockets can be made identical to the lamp sockets and, in that case, different keying arrangements or different coloring codes can be employed to advise a consumer of the correct mounting arrangement.

Each fuse works in a conventional manner. If the current exceeds a predetermined danger level, then the fuse will melt thereby open-circuiting the string of lamps.

The location of the fuses in the immediate vicinity of the string is a fail-safe solution to the problem caused when a consumer circumvents the standard home fuses by inserting a metallic object in the fuse box.

It will be understood that each of the elements described above, or two or more together, may also find a useful application in other types of constructions differing from the types described above.

While the invention has been illustrated and described as embodied in a miniature socketed fuse for a decorative string of series-connected miniature incandescent lamps, it is not intended to be limited to the details shown, since various modifications and structural changes may be made without departing in any way from the spirit of the present invention.

Without further analysis, the foregoing will so fully reval the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be secured by Letters Patent is set forth in the appended claims:

1. In a decorative string set of incandescent lamps including (A) a plurality of molded miniature plastic lamp sockets, (B) elongated flexible conductor means interconnecting said sockets and forming a string of series-connected sockets, (C) a plurality of shunted miniature lamps each having a molded miniature plastic lamp base mounted in a respective lamp socket, and (D) an electrical power plug electrically connected to said conductor means for supplying electrical power to said sockets and said lamps to cause the latter to operate as a decorative light display, an improved electrical fuse for protecting said string set in the event of a current overload, said improved fuse comprising:

(a) a fuse socket having fire-resistant and electrically-insulating wall portions bounding an elongated interior compartment which has an open end, and a pair of electrical contacts mounted in spaced-apart relationship within said compartment, (i) said contacts being electrically connected to said conductor means in series with said lamp sockets;

(b) an elongated fuse body insertable with frictional engagement into said compartment through said open end thereof, said fuse body having fire-resistant and electrically insulating wall portions bounding a bore which has a base wall and an open end at one axial end region of said fuse body, and bounding a pair of interior passageways which extend from said base wall in direction lengthwise of said fuse body to the other opposite axial end region thereof;

(c) a bendable, electrically-conductive metallic fuse wire of uniform diameter on said fuse body, said fuse wire having a central wire portion located in said bore adjacent said base wall thereof, a pair of intermediate wire portions each located in and extending through a respective passageway, and a pair of end wire portions each bent generally rearwardly in a direction from said other axial end region of said fuse body towards said one axial end region thereof, (i) each bent end wire portion overlying the outer surface of said fuse body and engaging the respective contacts in said sockets to thereby establish an electromechanical connection therewith when said fuse body is inserted into said compartment of said socket;

(d) keying means on said fuse socket and said fuse body for properly locating the latter in the former; and (e) a fuse plug insertable with frictional engagement into said bore through said open end of said fuse body, said fuse plug being of fire-resistant and electrically-insulating material and overlying said central wire portion of said fuse wire to thereby enclose the latter in an environment which is resistant to heat and fire, whereby said string set and objects in the circumambient region of said string set are protected from high heat in the event that said fuse wire melts due to a current overload.

2. The improved fuse as defined in claim 1, wherein said keying means includes a keying projection of one-piece with said fuse socket, said keying projection being located within said compartment.

3. The improved fuse as defined in claim 2, wherein said keying projection is located intermediate said contacts, extends lengthwise of said compartment, and terminates short of said open end of said compartment.

4. The improved fuse as defined in claim 2, wherein said keying means further includes a keying recess on said fuse body, said keying recess being dimensioned to mate with said keying projection.

5. The improved fuse as defined in claim 1, wherein said fuse body has a pair of elongated legs of one-piece with the same at said other axial end region of said fuse body, said legs being spaced apart of each other to define a keying recess therebetween.

6. The improved fuse as defined in claim 5, wherein each of said passageways extends through a respective leg, and wherein each leg has a tapered tip, and wherein each bent end wire portion overlies the outer surface of the respective tip.

7. The improved fuse as defined in claim 5, wherein each leg has a generally polygonal cross-sectional shape.

8. The improved fuse as defined in claim 1, wherein said fuse body has a tapered outer surface for facilitating insertion into said compartment.

9. The improved fuse as defined in claim 1; and further comprising means for facilitating handling of said fuse body, said handling means including a flange of one-piece with said fuse body and extending radially outwardly from the same.

10. The improved fuse as defined in claim 1, wherein said bore is a generally cylindrical bore, and wherein said fuse plug is a generally cylindrical plug.

11. The improved fuse as defined in claim 1, wherein said fuse plug has a leading plug end which is tapered for facilitating insertion into said bore.

12. The improved fuse as defined in claim 1; and further comprising means for adhesively sealing said fuse plug into said bore upon insertion of the former into the latter.

13. The improved fuse as defined in claim 12, wherein said sealing means is a coating of adhesive which extends from said fuse plug to said fuse body to thereby seal said bore.

14. The improved fuse as defined in claim 1; and further comprising an additional electrical fuse identical to said first-mentioned electrical fuse, said fuses being located at opposite ends of said string of series-connected lamp sockets.

15. An improved electrical fuse comprising:

(a) a fuse socket having fire-resistant and electrically-insulating wall portions bounding an elongated interior compartment which has an open end, and a pair of electrical contacts mounted in spaced-apart relationship within said compartment;

(b) an elongated fuse body insertable with frictional engagement into said compartment through said open end thereof, said fuse body having fire-resistant and electrically-insulating wall portions bounding a bore which has a base wall and an open end at one axial end region of said fuse body, and bounding a pair of interior passageways which extend from said base wall in direction lengthwise of said fuse body to the other opposite axial end region thereof;

(c) a bendable, electrically-conductive metallic fuse wire of uniform diameter on said fuse body, said fuse wire having a central wire portion located in said bore adjacent said base wall thereof, a pair of intermediate wire portions each located in and extending through a respective passageway, and a pair of end wire portions each bent generally rearwardly in a direction from said other axial end region of said fuse body towards said one axial end region thereof.

(i) each bent end wire portion overlying the outer surface of said fuse body and engaging the respective contacts in said sockets to thereby establish an electromechanical connection therewith when said fuse body is inserted into said compartment of said socket;

(d) keying means on said fuse socket and said fuse body for properly locating the latter in the former; and (e) a fuse plug insertable with frictional engagement into said bore through said open end of said fuse body, said fuse plug being of fire-resistant and electrically-insulating material and overlying said central wire portion of said fuse wire to thereby enclose the latter in an environment which is resistant to heat and fire.

* * * * *